US009539482B2

(12) United States Patent
Parnell

(10) Patent No.: US 9,539,482 B2
(45) Date of Patent: Jan. 10, 2017

(54) BATTER ASSIST POWER TRAINER DEVICE

(71) Applicant: Tim Parnell, Alexandria, IN (US)

(72) Inventor: Tim Parnell, Alexandria, IN (US)

( * ) Notice: Subject to any disclaimer, the term of this patent is extended or adjusted under 35 U.S.C. 154(b) by 0 days.

(21) Appl. No.: 14/524,962

(22) Filed: Oct. 27, 2014

(65) Prior Publication Data

US 2015/0119211 A1 Apr. 30, 2015

Related U.S. Application Data

(60) Provisional application No. 61/896,256, filed on Oct. 28, 2013.

(51) Int. Cl.

*A63B 21/008* (2006.01)
*A63B 69/00* (2006.01)
*A63B 15/00* (2006.01)

(52) U.S. Cl.

CPC ..... *A63B 69/0002* (2013.01); *A63B 15/00* (2013.01); *A63B 21/0088* (2013.01); *A63B 59/50* (2015.10); *A63B 2069/0008* (2013.01); *A63B 2102/18* (2015.10); *A63B 2209/10* (2013.01)

(58) Field of Classification Search

CPC ..... A63B 21/0004; A63B 21/00043; A63B 21/00069; A63B 21/00076; A63B 21/008; A63B 21/0085; A63B 21/0088; A63B 21/15; A63B 21/159; A63B 21/4023; A63B 21/4027; A63B 21/4035; A63B 2023/003; A63B 23/12; A63B 23/1209; A63B 23/1245; A63B 23/1281; A63B 59/50; A63B 69/0002; A63B 2069/0004; A63B 2069/0008; A63B 2102/18; A63B 2102/182; A63B 2208/02; A63B 2208/0204; A63B 2208/0209; A63B 21/4043; A63B 2060/006; A63B 2225/01; A63B 59/55; A63B 59/58; A63B 69/0028; A63B 69/0066

USPC ..... 473/313, 564–566

See application file for complete search history.

(56) References Cited

U.S. PATENT DOCUMENTS 3,048,399 A * 8/1962 Breitbach ..... A63B 51/04 473/457
3,463,492 A * 8/1969 White ..... A63B 59/50 473/453
3,516,669 A * 6/1970 Gray ..... A63B 59/50 473/453
3,809,397 A 5/1974 Gruenwald
(Continued)

*Primary Examiner* — Stephen Crow
*Assistant Examiner* — Gary D Urbiel Goldner
(74) *Attorney, Agent, or Firm* — Ritchison Law Offices, PC; John D Ritchison

(57) ABSTRACT

A practice device for use with a bat in batting sports to instruct a batter on proper swing technique and form. It is a batter assist power trainer for sports exercise. This relates to an exercise method and apparatus for improving performance in sports that include swinging of a device such as a bat. It is a batter assist power trainer device made of an airtight airfoil structure made of flexible and durable material and a method or way for connecting the structure to a bat so that the batter assist power trainer device permits a batter to power train and to controllably increase hitting strength which allows the batter to achieve longer hits of a ball for baseball and/or softball. Other configurations include structures made with end sections, with reinforcing splines; and a various ways to connect the device to the bat.

4 Claims, 9 Drawing Sheets

(56) References Cited

Figures 2, 2A, 2B, 2C, 2D, 2E:
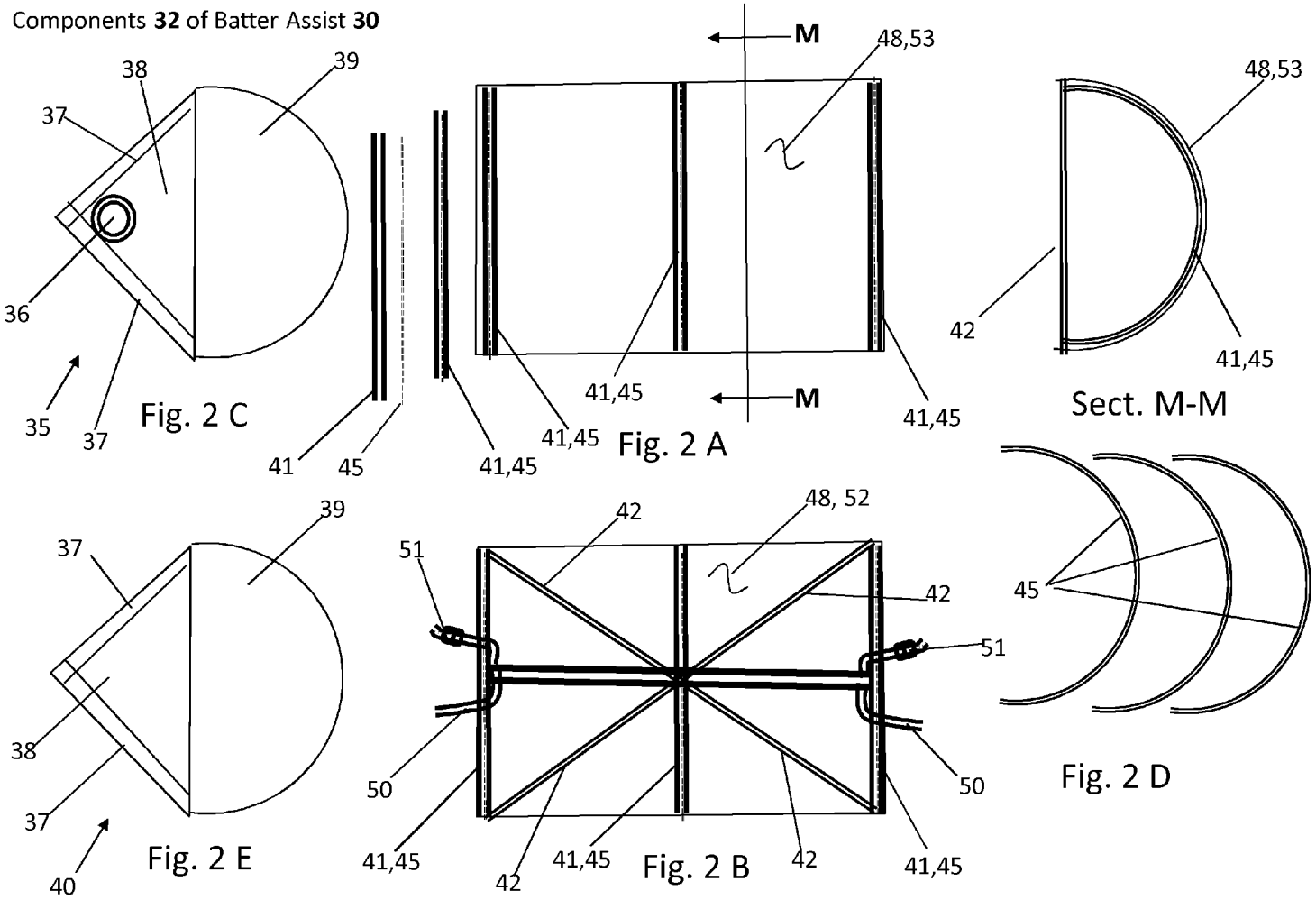

U.S. PATENT DOCUMENTS 3,833,217 A * 9/1974 Greaney ..... A63B 69/0002 473/457
4,907,800 A 3/1990 Passamaneck et al.
5,002,275 A * 3/1991 Beutler ..... A63B 69/3632 434/252
5,058,890 A 10/1991 Szabo
5,100,148 A * 3/1992 Smith ..... A63B 15/00 473/228
5,150,897 A * 9/1992 Wortman ..... A63B 59/50 473/567
5,165,683 A * 11/1992 Beutler ..... A63B 15/00 434/252
5,184,825 A * 2/1993 Ruth ..... A63B 21/0088 273/DIG. 30
5,186,699 A * 2/1993 Dimmig ..... A63B 21/0088 473/228
5,207,625 A 5/1993 White
5,335,918 A * 8/1994 Rupnik ..... A63B 24/0003 473/228
5,395,107 A * 3/1995 De Pippo ..... A63B 21/0088 473/228
5,415,406 A * 5/1995 Reichenbach ..... A63B 69/3632 473/228
5,571,048 A * 11/1996 Kenney ..... A63B 21/0088 473/228
5,803,838 A 9/1998 DeMarini
5,888,154 A 3/1999 Hartman
6,881,156 B1 * 4/2005 Phillips ..... A63B 69/3632 473/228
7,004,850 B1 * 2/2006 Hong ..... A63B 69/3685 473/219
7,112,152 B1 * 9/2006 Chen ..... A63B 21/0088 473/457
7,118,490 B2 * 10/2006 Namba ..... A63B 69/3632 473/226
7,285,055 B2 * 10/2007 Radle ..... A63B 69/3632 473/226
7,458,900 B1 * 12/2008 Park ..... A63B 21/0088 473/226
7,753,805 B2 * 7/2010 Scaperotti ..... A63B 21/0088 473/226
7,762,929 B1 * 7/2010 Celone ..... A63B 21/0088 482/109
7,993,220 B2 * 8/2011 Enday ..... A63B 69/38 473/459
8,202,204 B2 6/2012 Celone et al.
8,998,740 B2 * 4/2015 Corcoran ..... A63B 21/0088 473/228
2003/0207719 A1 * 11/2003 Hughes ..... A63B 15/00 473/228
2006/0116258 A1 * 6/2006 Shifferaw ..... A63B 23/03525 482/111
2006/0287122 A1 * 12/2006 Ray ..... A63B 69/3638 473/228
2008/0261729 A1 * 10/2008 Mullin ..... A63B 47/02 473/457
2010/0234146 A1 * 9/2010 Mullin ..... A63B 47/02 473/517
2011/0070978 A1 * 3/2011 Chandless ..... A63B 43/007 473/423
2011/0160004 A1 * 6/2011 Imatoh ..... A63B 21/0088 473/422
2012/0184417 A1 7/2012 Yablonowski
2012/0258816 A1 * 10/2012 Celone ..... A63B 21/0088 473/228
2013/0079172 A1 * 3/2013 Roger ..... A63B 69/36 473/228
2014/0113752 A1 * 4/2014 Westcott ..... A63B 69/0002 473/422

* cited by examiner

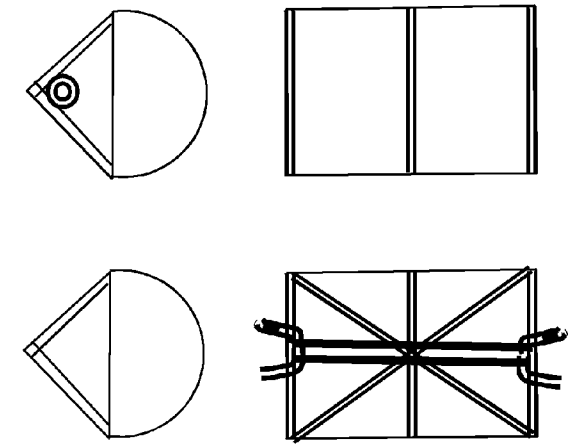
Fig. 1 A
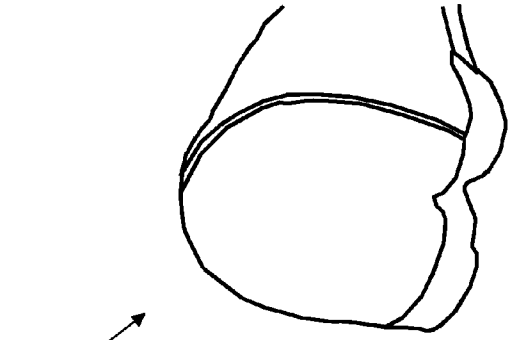
Fig. 1 B
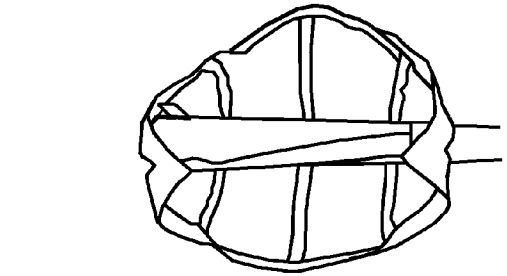
Fig. 1 C
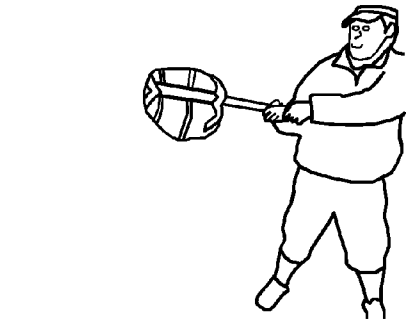
Fig. 1 D
Figs. 1

Components 32 of Batter Assist 30
39
38
37
36
35
37

45
41
41,45
41,45
41,45
41,45
41,45
M
M
48,53

48,53
41,45
42
Sect. M-M
51
42
48, 52
42
42
51
50
41,45
41,45
41,45
42
50
41,45

45

39
37
38
37
40

Prototype sketches 33 for the batter assist power trainer device 30

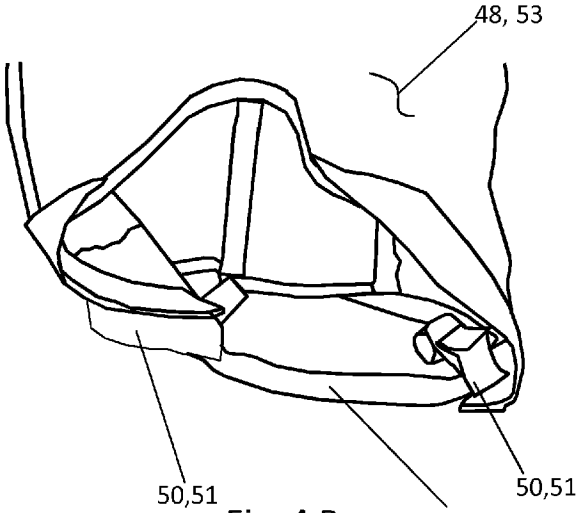
Fig. 4 B
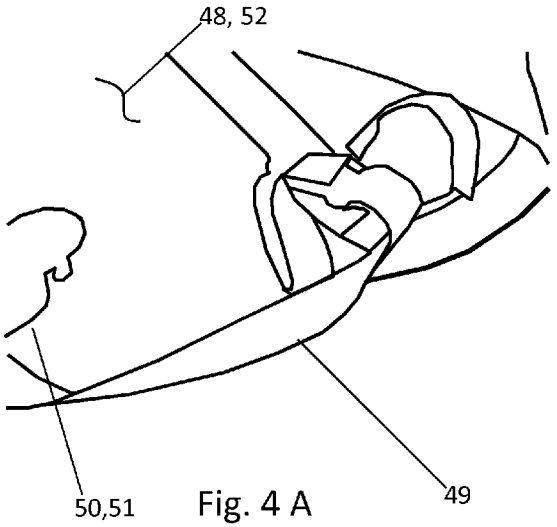
Fig. 4 A
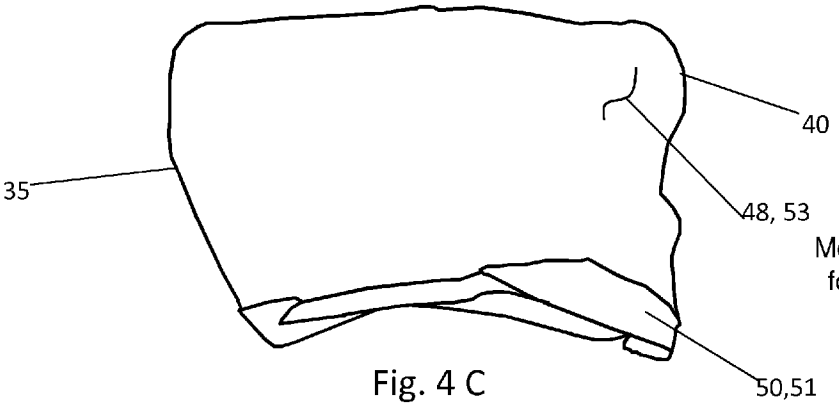
Fig. 4 C
Figs. 4
More Prototype sketches 33 for the batter assist power trainer device 30

Components 32 of the batter assist device 30 batter using 60 the batter assist power trainer device 30

Components 32 of the batter assist device 30
with Bat 63 inserted

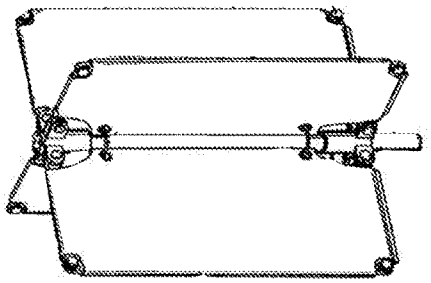
Fig. 9 B
Prior Art
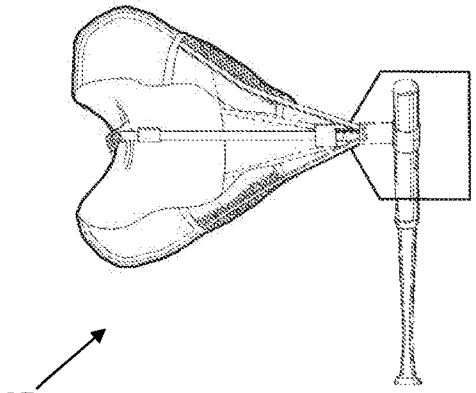
Fig. 9D
Prior Art
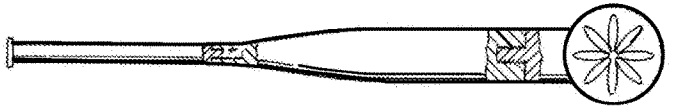
Fig. 9 A
Prior Art
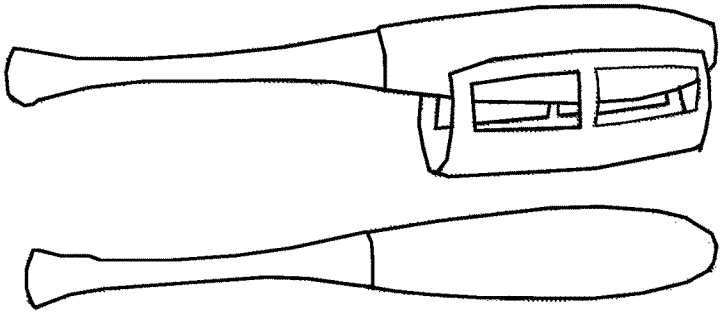
Fig. 9C
Prior Art
Figs. 9

BATTER ASSIST POWER TRAINER DEVICE

CROSS-REFERENCE TO RELATED APPLICATIONS

This application claims the benefit of U.S. Provisional Patent Application with Ser. No. 61/896,256 filed Oct. 28, 2013 by Tim Parnell and entitled "A batter assist power trainer device called a Wind Trainer".

FIELD OF INVENTION

This invention relates to a batter assist power trainer device called a WIND TRAINER. The device relates generally to sports exercise. More specifically, this application relates to an exercise method and apparatus for improving performance in sports that include swinging of a device such as a bat, or the like. This invention is a device and system for teaching a person the proper way to swing a baseball bat or the like. In general, the WIND TRAINER is a practice device for use with a bat in batting sports to instruct a batter on proper swing technique and form. The device also relates to a baseball training apparatus, and more particularly, to such a device which can be used to improve the power and hitting ability of a batter. The WIND TRAINER relates to a resistance training device for improving the swing of a baseball player, and athletes engaged in similar sports.

FEDERALLY SPONSORED RESEARCH

None.

SEQUENCE LISTING OR PROGRAM

None.

BACKGROUND

Field of Invention and Prior Art

A. Background

Various devices have been utilized to facilitate the development of muscular strength and coordination to produce a quick and powerful swing. The WIND TRAINER is an improved attachment for a baseball and/or softball bat which provides a substantially constant resistance to a bat during the entire normal swinging motion of a bat by a player. It has been found that prolonged practice swinging of the instant invention when attached to a bat will enhance a batters swing speed as well as his ball hitting power. In baseball and softball, power is important to batting performance. Particularly important, is the batter's power at ball impact. Greater power means the ball can be hit further. To improve batting power, players can swing an un-weighted, ordinary bat or a weighted bat. Weighted bats are more effective for improving batting power because greater force is required to accelerate the bat. Such weighted bats may be specially constructed solely to permit players to practice their swing or warm up. Alternatively, one or more donut-shaped weights can be removably mounted on an ordinary bat for these purposes.

B. Problem Addressed

In baseball and softball, power is important to batting performance. Particularly important, is the batter's power at ball impact. Greater power means the ball can be hit further. To improve batting power, players can swing an un-weighted, ordinary bat or a weighted bat. Weighted bats are more effective for improving batting power because greater force is required to accelerate the bat. Such weighted bats may be specially constructed solely to permit players to practice their swing or warm up. Alternatively, one or more donut-shaped weights can be removably mounted on an ordinary bat for these purposes.

However, weighted bats have drawbacks because their larger mass adds downward gravitational force that is not present in ordinary bats. Such downward force may feel unnatural to a batter and adversely affect the batter's batting form. Excessive weighting of the bat may even harmfully strain a player. Moreover, as with an un-weighted bat, swinging a weighted bat does not simulate the impact of the bat against a ball. Thus, there is a need for a training device that builds a batter's swinging power and simulates an un-weighted bat striking a ball.

Further, athletic training equipment is often tailored to suit the needs of athletes engaged in specific sports. For example, machines that simulate cross-country skiing and rowing are available. In addition to providing aerobic exercise and improving cardiovascular fitness, these devices strengthen muscles by providing resistance against which the muscles must work. However, rather than being generalized resistance training machines, these machines target specific muscle groups involved in performing the repetitive motion by providing resistance peculiar to a particular motion. Such devices allow the athlete to train under controlled conditions that closely approximate the actual sport. Under these controlled conditions, the athlete may focus on improving a particular aspect of the repetitive motion involved in the sport in addition to increasing his endurance and strength.

A desirable characteristic of baseball players is that they possess acceptable hitting skills. Two of the most important contributors to good hitting are power and the ability to swing so as to have the bat meet the ball. Until now, the only generally accepted way of developing power has been through practice coupled with weight training to develop the muscles of the upper body. Similarly, attempts at increasing one's ability to hit a ball have generally focused on practice coupled with the use of complex devices. While practice, weight training, and the use of existing training devices have proved somewhat helpful, there is a perceived need for a baseball training device which can simultaneously increase the power of a swing, while at the same time developing a swing which will result in the batter more effectively gaining contact with the ball.

C. Prior Art

Figures 8, 8A, 8B, 8C:
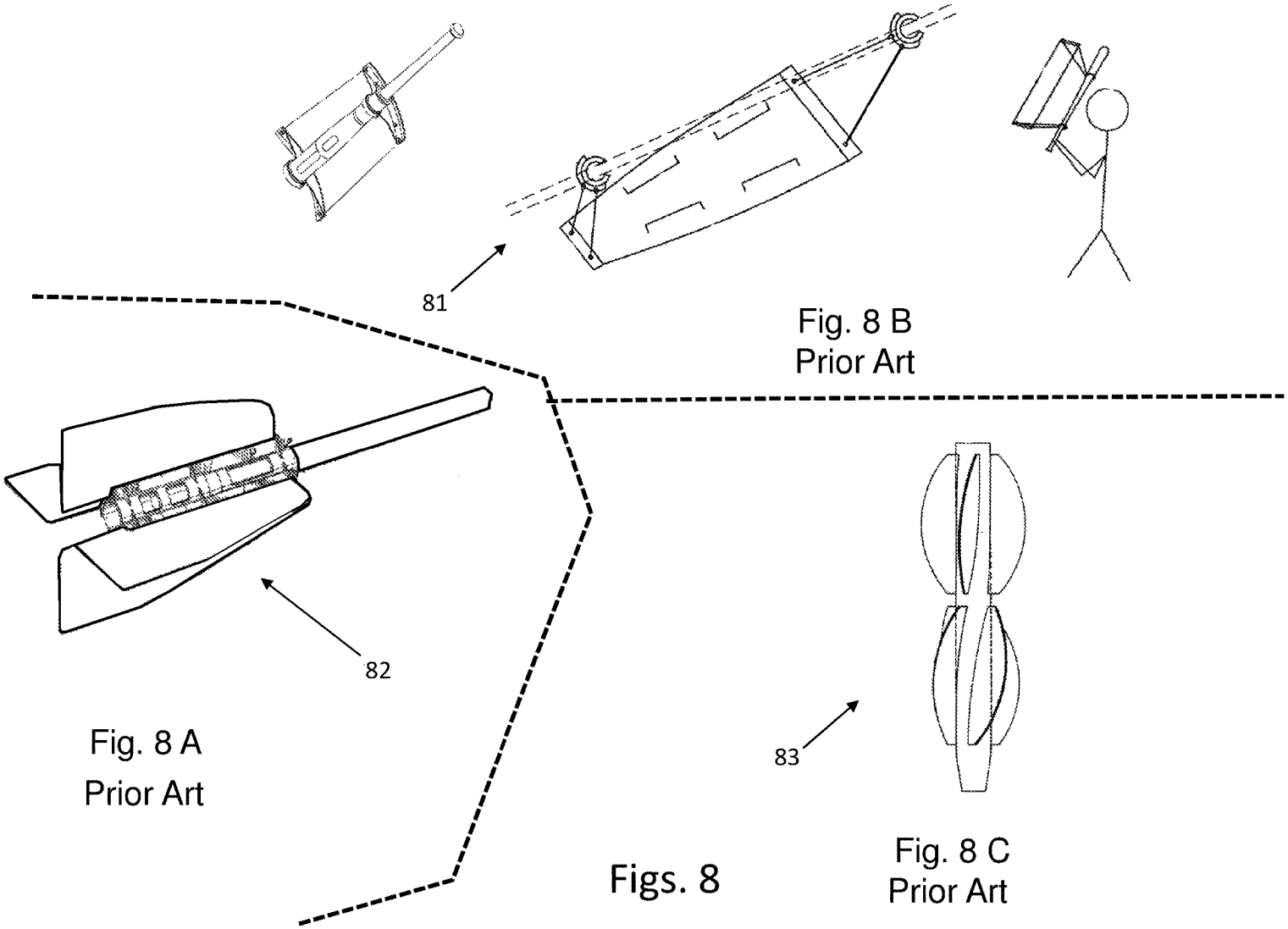
Fig. 8 A Prior Art
Fig. 8 B Prior Art
Fig. 8 C Prior Art

FIGS. 8 A through 8 C and FIGS. 9 A through 9 D are prior art devices and are examples of more expensive and more complicated prior art devices. Prior art U.S. Pat. No. 8,202,204 (2012) issued to Celone, et al. and Publication 2012/0184417 shows a method and a device are disclosed for improving performance in sports where a swinging motion is needed called a sports swinging exercise device and method. Prior art U.S. Pat. No. 3,809,397 (1974) issued to Gruenwald demonstrates an exercise apparatus for use in conjunction with an ordinary baseball bat including a tubular tapered body that is inserted over the handle end of the bat and lodges near the hitting end of the bat. Prior art U.S. Pat. No. 5,058,890 (1991) issued to Szabo is called a power-swing bat speed enhancer. It portrays a bat swing speed and power device that is enhanced and comprised of a cylindrical member having two sets of a plurality of spaced apart wing elements extending from its surface in a pattern about the longitudinal axis of the cylindrical member. The wings of each set are attached to the cylindrical member at an angle relative to the longitudinal axis of the cylindrical member and being equally spaced about the longitudinal axis of the member. Another prior art U.S. Pat. No. 4,907,800 (1990) issued to Passamaneck et al. is a bat swing practice apparatus. It demonstrates a device that is a training aid that has a handle with a fan section at its far end. The fan section provides resistance to swinging the handle. The fan section has a rotatable fan and a friction element which varies the rotational resistance of the fan. Further, prior art U.S. Pat. No. 5,207,625 (1993) issued to White shows a collapsible swing motion device described as a swing motion device for providing exercise and training has a plurality of collapsible vanes mounted on a shaft that an athlete may grip and swing through the air. The vanes provide air resistance against which the athlete's muscles must work. Each vane may comprise a foldable wire framework covered with a bag-like fabric sheath. When the vanes are collapsed, the device assumes a compact shape that facilitates transport and storage. One more prior art U.S. Pat. No. 5,888,154 (1999) issued to Hartman is a resistance device for a baseball bat. It provides a resistance device for a baseball bat including a cylindrical sleeve dimensioned for receiving a barrel of a baseball bat therein. Finally, prior art U.S. Pat. No. 5,803,838 (1998) issued to DeMarini, et al is a drogue for sports bats and clubs.

All these prior art devices have, for the most part, been relatively bulky or cumbersome to use and relatively expensive compared with the Parnell device. Further, the prior art devices frequently interfered with the efficient practice and simplicity offered by Parnell because of their excessive weight and size. The device is lighter, more compact and uses simple components. As it relates to the other prior art in baseball, it accomplishes a result with a device that has not been anticipated nor is obvious from the other devices. As far as known, there are no A Batter Assist Power Trainer Devices or their equivalent. It is believed that this product is unique in its design and technologies.

SUMMARY OF THE INVENTION

A batter assist power trainer device called a WIND TRAINER that provides a simple and portable device for power training batters of various ages. The embodiment is a batter assist power trainer device called a WIND TRAINER with an inner and outer surface comprised of: (a) an airtight airfoil structure made of flexible and durable material; and (b) a means for connecting the structure to a bat wherein the batter assist power trainer device permits a batter to power train and to controllably increase hitting strength which allows the batter to achieve longer hits of a ball for baseball and/or softball. Alternative embodiments are the structure comprised of ends sections and a back; the structure comprised with reinforcing splines; and the means to connect to the bat including Velcro®, snaps, zippers and other mechanical hook and eyes. The preferred embodiment is a batter assist power trainer device used with a bat called a WIND TRAINER with an inner and outer surface comprised of: (a) an airtight airfoil structure made of a lightweight, somewhat air tight and flexible material wherein the airfoil is a structure further comprised of one essentially triangle and a half-moon end section; a second essentially triangle and a half-moon end section with an aperture for the bat; and an essentially rectangular section interposed and securely connected between the two end sections and is a structure further comprised of reinforcing at least one spline/curvable stiffener; and (b) a Velcro® strap for connecting the structure to a bat wherein the batter assist power trainer device permits a batter to power train and to controllably increase hitting strength which allows the batter to achieve longer hits of a ball for baseball and/or softball.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

OBJECTS AND ADVANTAGES

The Advantages and Benefits of the batter assist power trainer device called a WIND TRAINER include but are limited to:

| Item | Advantages |
|---|---|
| 1 | Is portable |
| 2 | Is useful for various age groups of baseball and softball players |
| 3 | Helps young and old players improve strength and power for hitting |
| 4 | Requires no special machinery |
| 5 | Easily attaches to players bat |
| 6 | Provides support for sports that use rackets of hitting/volleying devices where power is a factor |

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

DESCRIPTION OF THE DRAWINGS—FIGURES

The accompanying drawings, which are incorporated in and constitute a part of this specification, illustrate an embodiment of the batter assist power trainer device called a WIND TRAINER that is preferred. The drawings together with the summary description given above and a detailed description given below serve to explain the principles of the batter assist power trainer device called a WIND TRAINER. It is understood, however, that the batter assist power trainer device called a WIND is not limited to only the precise arrangements and instrumentalities shown.

FIGS. 1 A through 1 D are various sketches of the batter assist power trainer device called a WIND TRAINER, prototype and use.

FIGS. 2 A through 2 E are sketches and components of the batter assist power trainer device called a WIND TRAINER kit with front, back side vies and sections.

Figures 3, 3A, 3B, 3C, 3D, 3E:
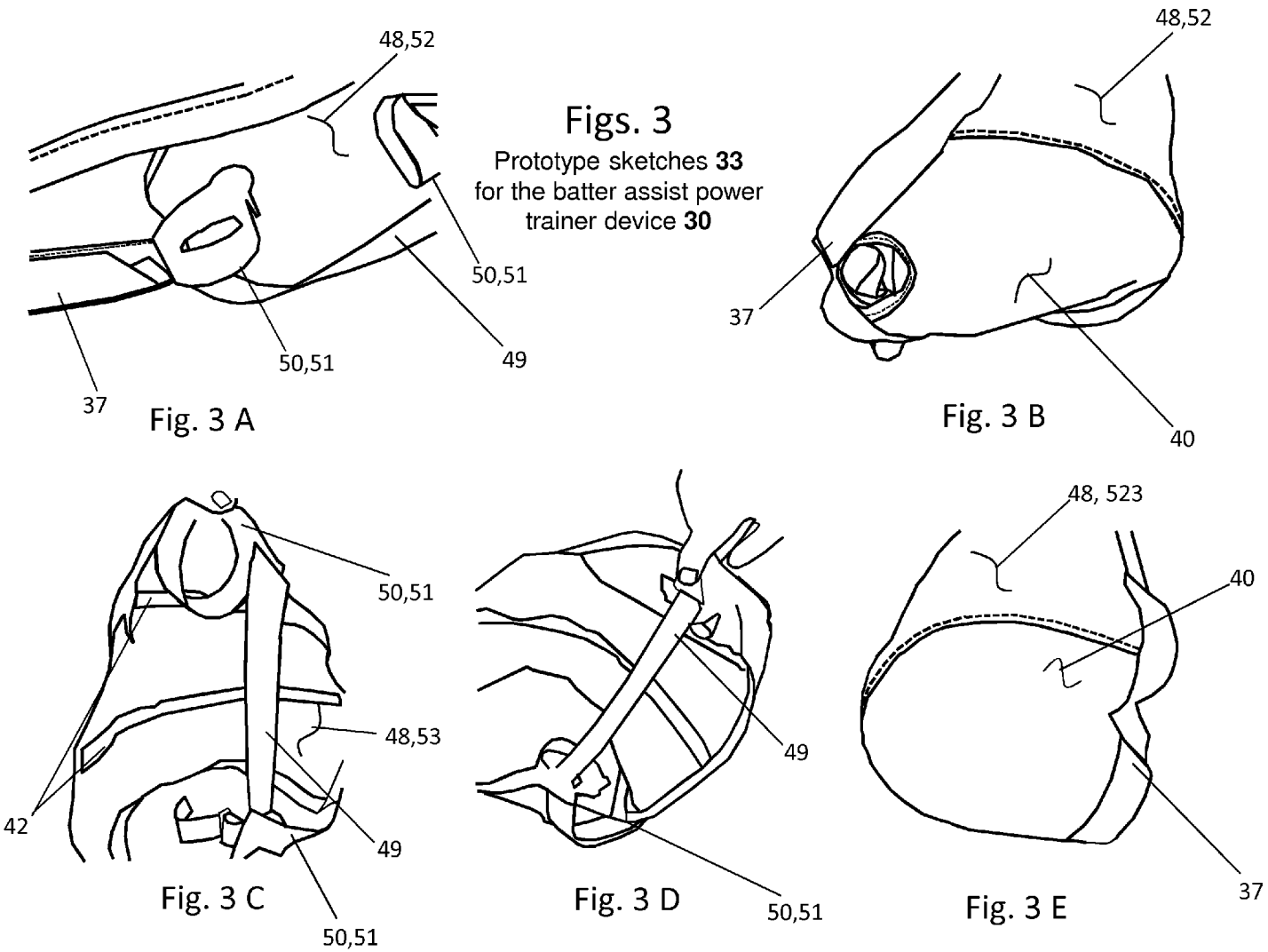

FIG. 3 A through FIG. 3 E are sketches of prototypes of the batter assist power trainer device called a WIND TRAINER with components identified.

FIG. 4 A through FIG. 4 C are additional sketches of the batter assist power trainer device called a WIND TRAINER with components identified.

Figure 5:
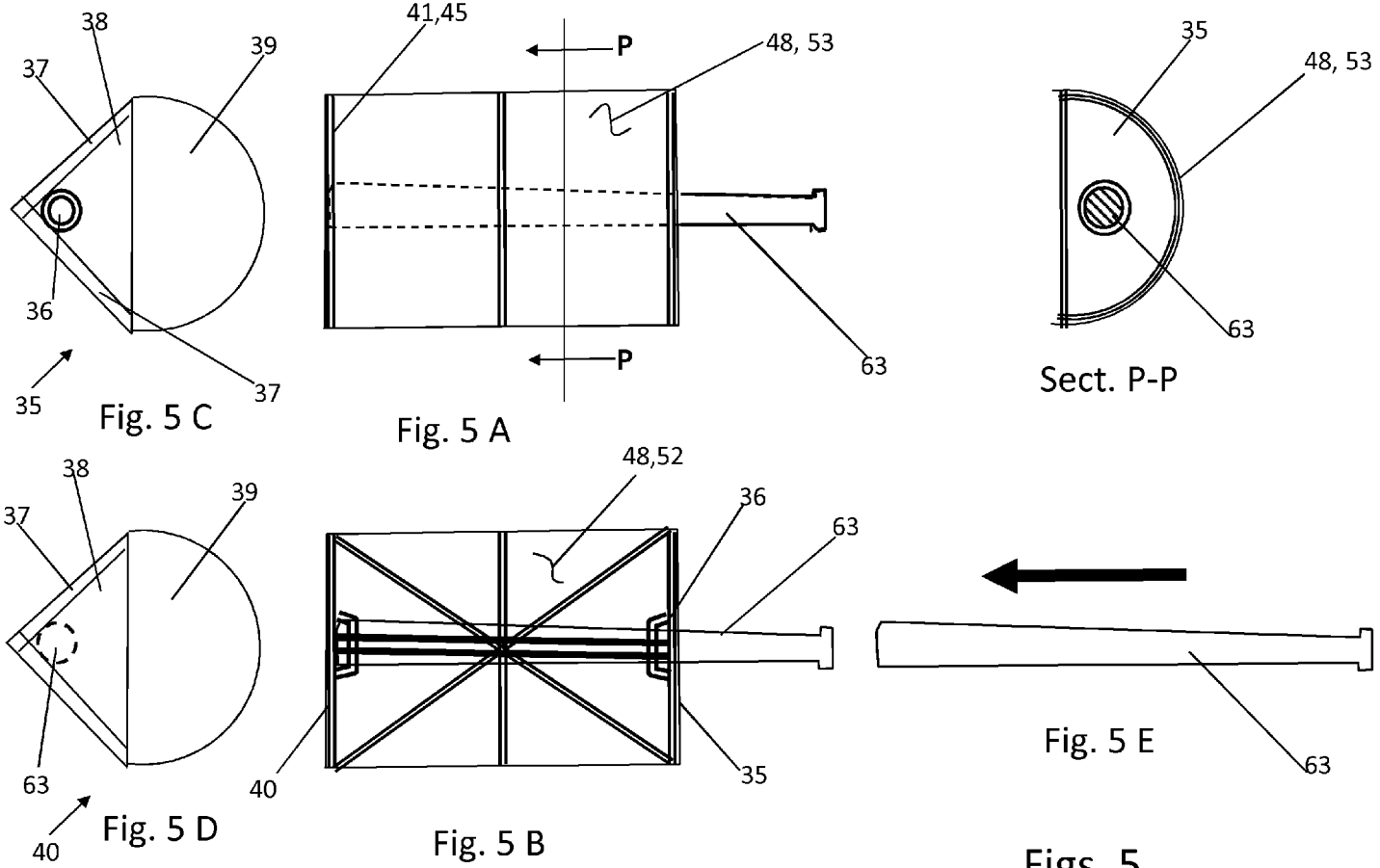

FIG. 5 A through 5 E and sections are sketches of the batter device in use.

Figure 6:
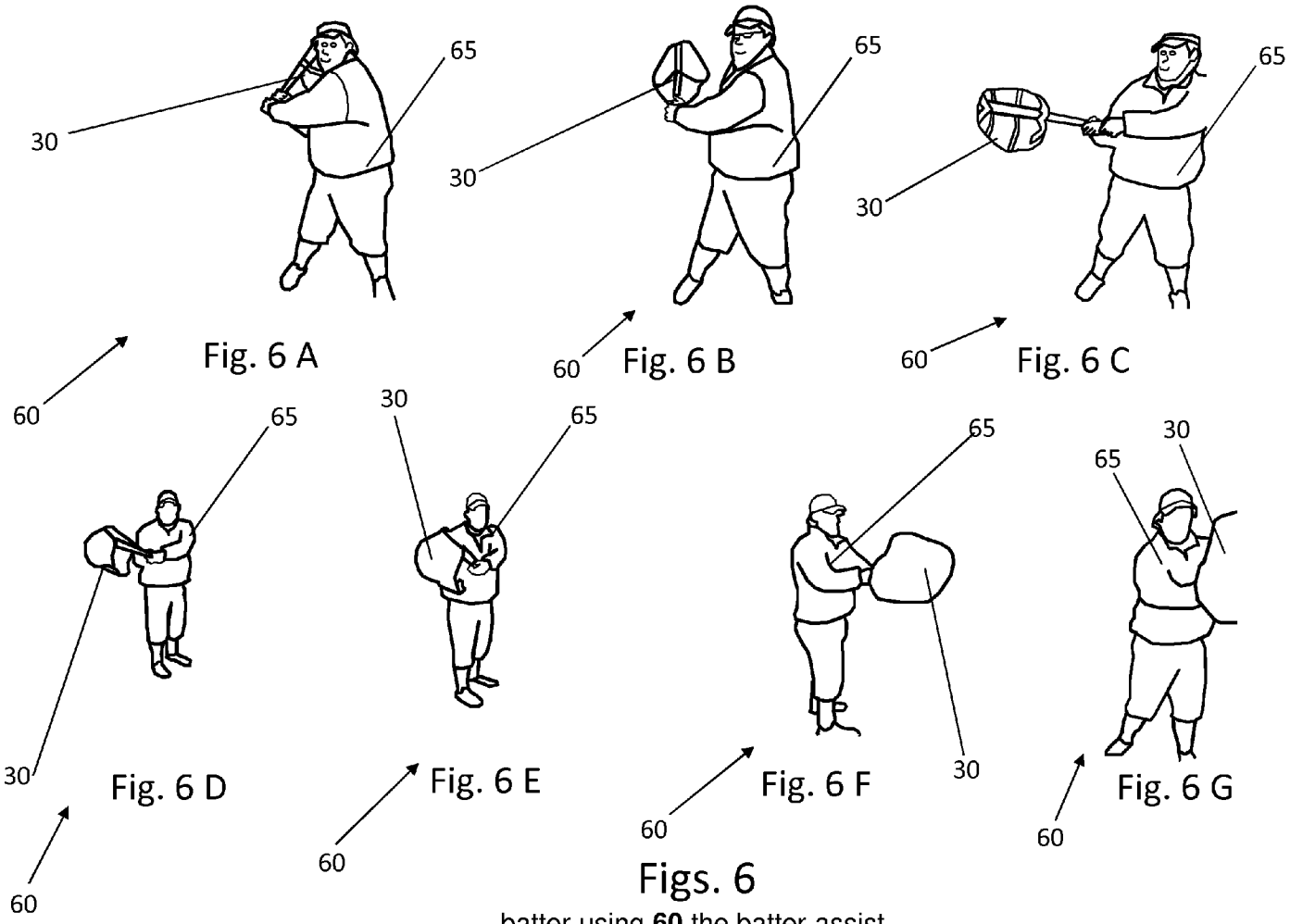

FIG. 6 A through 6 G are sketches showing the batter assist power trainer device in step by step positions of use.

Figure 7:
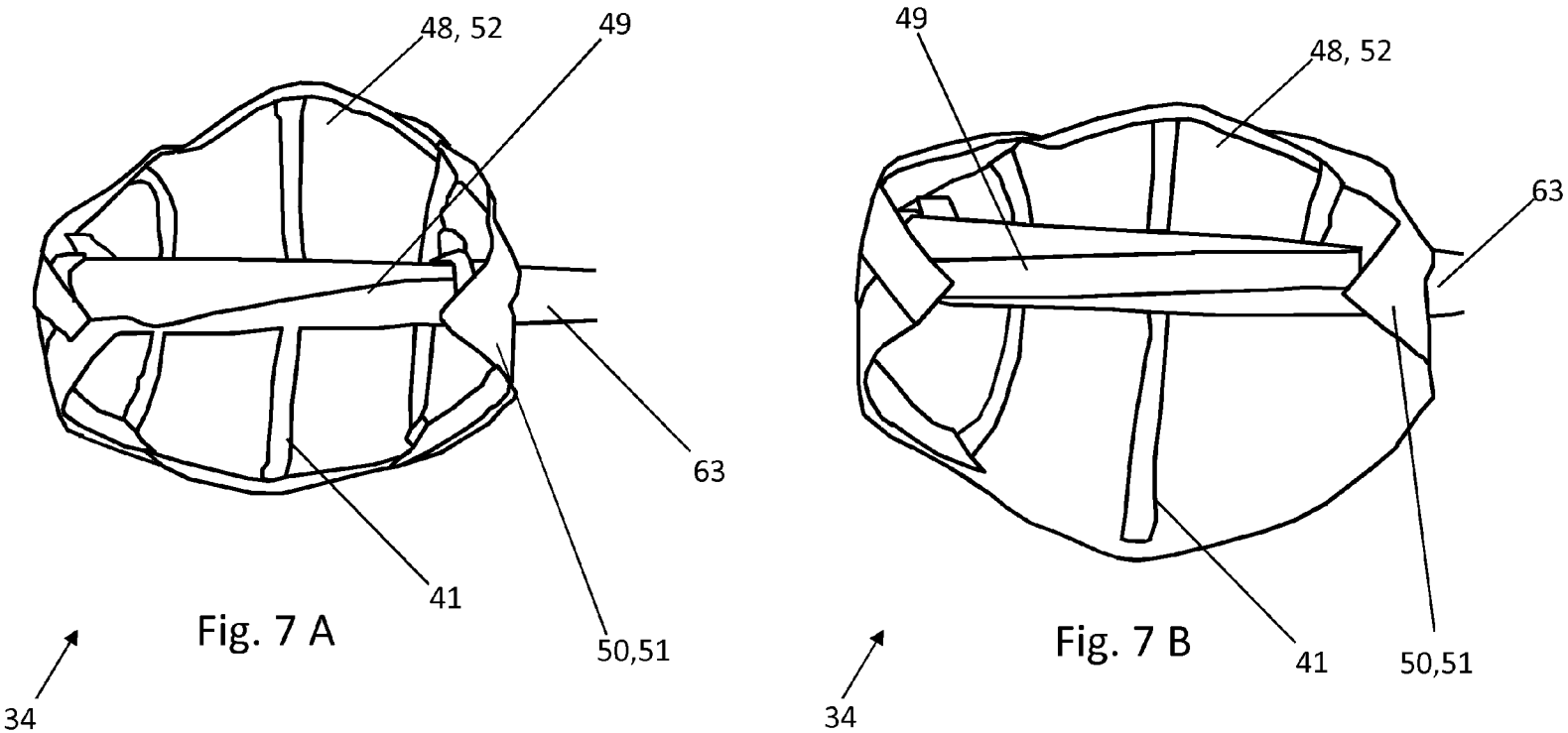

FIGS. 7 A and 7 B components of a batter assist power trainer device.

FIGS. 8 A through 8 C are demonstrations of prior art devices.

FIGS. 9 A through 9 D are demonstrations of prior art devices.

DESCRIPTION OF THE DRAWINGS—REFERENCE NUMERALS

The following list refers to the drawings:

TABLE A

| Reference numbers | |
|---|---|
| Ref # | Description |
| 30 | a batter assist power trainer device called a WIND TRAINER. |
| 32 | components for the batter assist power trainer device 30 |
| 33 | prototype sketch for the batter assist power trainer device called a WIND TRAINER. |
| 34 | prototype with a bat inserted and removably attached |
| 35 | end panel for bat 63 insertion |
| 36 | through aperture for bat 63 |
| 37 | edge reinforcement |
| 38 | triangle segment |
| 39 | half-moon section |
| 40 | end panel opposite bat insertion |
| 41 | containment seams |
| 42 | reinforcement seams |
| 45 | curvable stiffeners—tubes, straws, flexible and elongated thin columns or the like made of metal, composite materials plastic etc. |
| 48 | back panel |
| 49 | cross strap from end 35 to end 40 |
| 50 | removable securement strap—Velcro RTM, snaps, zipper or the like |
| 51 | means for adjusting securement strap 50 |
| 52 | inner surface of the structure |
| 53 | outer surface of the structure |
| 60 | batter using the batter assist power trainer device 30 |
| 63 | bat |
| 65 | batter |
| 81 | prior art U.S. Pat. No. 8,202,204 and Publication 2012/0184417 |
| 82 | prior art U.S. Pat. No. 3,809,397 |
| 83 | prior art U.S. Pat. No. 5,058,890 |
| 84 | prior art U.S. Pat. No. 4,907,800 |
| 85 | prior art U.S. Pat. No. 5,207,625 |
| 86 | prior art U.S. Pat. No. 5,888,154 |
| 87 | prior art U.S. Pat. No. 5,803,838 |

DETAILED DESCRIPTION OF PREFERRED EMBODIMENT

The present development is a batter assist power trainer device called a WIND TRAINER. This application relates generally to sports exercise. More specifically, this application relates to an exercise method and apparatus for improving performance in sports that include swinging of a device such as a bat, or the like. This invention relates further to a device and system for teaching a person the proper way to swing a baseball bat or the like. In general, the WIND TRAINER is a practice device for use with a bat in batting sports to instruct a batter on proper swing technique and form. Therefore it relates generally to a baseball training apparatus, and more particularly, to such a device which can be used to improve the power and hitting ability of a batter. The batter assist power trainer device called a WIND TRAINER relates to a resistance training device for improving the swing of a baseball player, and athletes engaged in similar sports.

The invention presented here is a batter assist power trainer device 30 called a WIND TRAINER has several advantages and benefits:

1. Is portable
2. Is useful for various age groups of baseball and softball players
3. Helps young and old players improve strength and power for hitting
4. Requires no special machinery
5. Easily attaches to players bat
6. Provides support for sports that use rackets of hitting/volleying devices where power is a factor The embodiment is a batter assist power trainer device called a WIND TRAINER and comprised of: (a) an airtight airfoil structure made of flexible and durable material; and (b) a means for connecting the structure to a bat wherein the batter assist power trainer device permits a batter to power train and to controllably increase hitting strength which allows the batter to achieve longer hits of a ball for baseball and/or softball. Alternative embodiments are the structure comprised of ends sections and a back; the structure comprised with reinforcing splines; and the means to connect to the bat including Velcro®, snaps, zippers and other mechanical hook and eyes. The preferred embodiment is a batter assist power trainer device used with a bat called a WIND TRAINER with an inner and outer surface comprised of: (a) an airtight airfoil structure made of a lightweight, somewhat air tight and flexible material wherein the airfoil is a structure further comprised of one essentially triangle and a half-moon end section; a second essentially triangle and a half-moon end section with an aperture for the bat; and an essentially rectangular section interposed and securely connected between the two end sections and is a structure further comprised of reinforcing at least one spline/curvable stiffener; and (b) a Velcro® strap for connecting the structure to a bat wherein the batter assist power trainer device permits a batter to power train and to controllably increase hitting strength which allows the batter to achieve longer hits of a ball for baseball and/or softball.

The accompanying drawings, which are incorporated in and constitute a part of this specification, illustrate an embodiment of the batter assist power trainer device 30 called a WIND TRAINER that is preferred. The drawings together with the summary description given above and a detailed description given below serve to explain the principles of the batter assist power trainer device 30.

There is shown in FIGS. 1-9 a description and operative embodiment of the batter assist power trainer device 30. In the drawings and illustrations, one notes well that the FIGS. 1-4 demonstrate the general configuration, and FIGS. 5 and 6 show examples but not limitations of the batter assist power trainer device 30 called a WIND TRAINER. These various example uses are in the operation and use section, below. FIG. 7 and FIG. 8 are prior art examples.

FIGS. 1 A through 1 D are various sketches of the batter assist power trainer device called a WIND TRAINER, prototype and use. FIG. 1 A shows the components 32 for the batter assist power trainer device 30. FIG. 1 B demonstrates a prototype sketch 33 for the batter assist power trainer device 30 called a WIND TRAINER. FIG. 1 C provides a prototype 34 with a bat 63 inserted and removably attached. And, FIG. 1 D demonstrates a batter 65 using 60 the batter assist power trainer device 30.

FIGS. 2 A through 2 E are sketches and components of the batter assist power trainer device 30 called a WIND TRAINER kit with front, back side views and sections. FIG. 2 A is back panel 48 of device 30; containment seams 41; and curvable stiffeners 45—tubes, straws, flexible and elongated thin columns or the like made of metal, composite materials plastic etc. FIG. 2 B shows back panel 48 of device 30; containment seams 41; and curvable stiffeners 45—tubes, straws, flexible and elongated thin columns or the like made of metal, composite materials plastic etc.; reinforcement seams 42; removable securement strap 50 such as Velcro®, snaps, zipper or the like; and means 51 for adjusting securement strap 50. FIG. 2 C demonstrates end panel 35 for bat 63 insertion; through aperture 36 for bat 63; edge reinforcement 37; end triangle segment 38 of device 30; and end half-moon section 39 of device 30. FIG. 2 D are the curvable stiffeners 45—tubes, straws, flexible and elongated thin columns or the like made of metal, composite materials plastic etc. FIG. 2 E is edge reinforcement 37; end triangle segment 38 of device 30; end half-moon section 39 of device 30; and end panel 40 opposite bat insertion. Also, there is a Section view M-M that shows containment seams 41; reinforcement seams 42; curvable stiffeners 45—tubes, straws, flexible and elongated thin columns or the like made of metal, composite materials plastic etc.; and back panel 48 of device 30. One should note that the anticipated materials are nylon, fabric or composite for the straps 50. The means 51 for adjustment are Velcro®, hooks and eyes, zippers, snaps and the like. The back 48 and ends 35, 40 anticipate a light, flexible and durable material that is somewhat air tight and resistant. For example, and not as a limitation: canvas, nylon mesh, composite fabric, etc. The drawings I FIGS. 2 A through 2 E show a device wherein the airfoil is a structure further comprised of one essentially triangle and a half-moon end section; a second essentially triangle and a half-moon end section with an aperture for the bat; and an essentially rectangular section interposed and securely connected between the two end sections.

FIG. 3 A through FIG. 3 E are sketches of prototypes 33 of the batter assist power trainer device 30 called a WIND TRAINER with components identified. FIG. 3 A is an edge reinforcement 37; cross strap 49 from end 35 to end 40; removable securement strap 50 such as Velcro®, snaps, zipper or the like; and means 51 for adjusting securement strap 50. FIG. 3 B shows edge reinforcement 37 and end panel 40 opposite bat insertion. FIG. 3 C provides reinforcement seams 42; cross strap 49 from end 35 to end 40; removable securement strap 50 such as Velcro®, snaps, zipper or the like; and means 51 for adjusting securement strap 50. FIG. 3 D demonstrates cross strap 49 from end 35 to end 40; removable securement strap 50 such as Velcro®, snaps, zipper or the like; and means 51 for adjusting securement strap 50. FIG. 3 E is edge reinforcement 37; end panel 40 opposite bat insertion; and back panel 48 of device 30.

FIG. 4 A through FIG. 4 C are additional sketches of prototypes 33 the batter assist power trainer device 30 called a WIND TRAINER with components identified. FIG. 4 A is back panel 48 of device 30; cross strap 49 from end 35 to end 40; removable securement strap 50 such as Velcro®, snaps, zipper or the like; and means 51 for adjusting securement strap 50. FIG. 4 B demonstrates back panel 48 of device 30; cross strap 49 from end 35 to end 40; removable securement strap 50 such as Velcro®, snaps, zipper or the like; and means 51 for adjusting securement strap 50. FIG. 4 C provides end panel 35 for bat 63 insertion; back panel 48 of device 30; end 40; removable securement strap 50 such as Velcro®, snaps, zipper or the like; and means 51 for adjusting securement strap 50.

FIGS. 5 A through 5 E, FIGS. 6 A through 6 G, and FIGS. 7 A and 7 B are sketches showing the batter assist power trainer device 30 called a WIND TRAINER in use. These uses and operations with the device are described in further detail below.

FIGS. 8 A through 8 C and FIGS. 9 A through 9 D are prior art devices and are examples of more expensive and more complicated prior art devices. Here are shown prior art U.S. Pat. No. 8,202,204 and Publication 2012/0184417—81; prior art U.S. Pat. No. 3,809,397—82; prior art U.S. Pat. No. 5,058,890—83; prior art U.S. Pat. No. 4,907,800—84; prior art U.S. Pat. No. 5,207,625—85; prior art U.S. Pat. No. 5,888,154—86; and prior art U.S. Pat. No. 5,803,838—87.

The details mentioned here are exemplary and not limiting. Other specific components and manners specific to describing a batter assist power trainer device 30 called a WIND TRAINER be added as a person having ordinary skill in the field of batter training devices and apparatuses and their uses well appreciates.

Operation of the Preferred Embodiment

The batter assist power trainer device 30 called a WIND TRAINER has been described in the above embodiment. The manner of how the device operates is described below. This invention relates to a batter assist power trainer device called a WIND TRAINER. The present development is a batter assist power trainer device called a WIND TRAINER. This application relates generally to sports exercise. More specifically, this application relates to an exercise method and apparatus for improving performance in sports that include swinging of a device such as a bat, or the like. This invention relates further to a device and system for teaching a person the proper way to swing a baseball bat or the like. In general, the WIND TRAINER is a practice device for use with a bat in batting sports to instruct a batter on proper swing technique and form. Therefore it relates generally to a baseball training apparatus, and more particularly, to such a device which can be used to improve the power and hitting ability of a batter. The batter assist power trainer device called a WIND TRAINER relates to a resistance training device for improving the swing of a baseball player, and athletes engaged in similar sports.

The embodiment is a batter assist power trainer device called a WIND TRAINER with an inner and outer surface comprised of: (a) an airtight airfoil structure made of flexible and durable material; and (b) a means for connecting the structure to a bat wherein the batter assist power trainer device permits a batter to power train and to controllably increase hitting strength which allows the batter to achieve longer hits of a ball for baseball and/or softball. Alternative embodiments are the structure comprised of ends sections and a back; the structure comprised with reinforcing splines; and the means to connect to the bat including Velcro®, snaps, zippers and other mechanical hook and eyes. The preferred embodiment is a batter assist power trainer device used with a bat called a WIND TRAINER with an inner and outer surface comprised of: (a) an airtight airfoil structure made of a lightweight, somewhat air tight and flexible material wherein the airfoil is a structure further comprised of one essentially triangle and a half-moon end section; a second essentially triangle and a half-moon end section with an aperture for the bat; and an essentially rectangular section interposed and securely connected between the two end sections and is a structure further comprised of reinforcing at least one spline/curvable stiffener; and (b) a Velcro® strap for connecting the structure to a bat wherein the batter assist power trainer device permits a batter to power train and to controllably increase hitting strength which allows the batter to achieve longer hits of a ball for baseball and/or softball.

FIG. 5 A through 5 E and sections are sketches of the batter device 30 in use. FIG. 5 A is back panel 48 of device 30; containment seams 41; curvable stiffeners 45—tubes, straws, flexible and elongated thin columns or the like; and bat 63. FIG. 5 B shows back panel 48 of device 30; containment seams 41; and curvable stiffeners 45—tubes, straws, flexible and elongated thin columns or the like; reinforcement seams 42; removable securement strap 50 such as Velcro®, snaps, zipper or the like; means 51 for adjusting securement strap 50; and bat 63. FIG. 5 C demonstrates back panel 48 of device 30; cross strap 49 from end 35 to end 40; removable securement strap 50 such as Velcro®, snaps, zipper or the like; and means 51 for adjusting securement strap 50. FIG. 5 D provides edge reinforcement 37; end triangle segment 38 of device 30; end half-moon section 39 of device 30; end panel 40 opposite bat insertion; and the location of the bat 63 behind the panel. FIG. 5 E is the bat 63. FIG. 5 Section P-P shows back panel 48 of device 30; end 35 and the bat 63.

FIG. 6 A through 6 G are sketches showing the batter assist power trainer device 30 in step by step positions of use 60 by a batter 65.

| Figure | Position and Use Shown |
|---|---|
| 6 A | Bat 63 and device 30 above the shoulder and ready |
| 6 B | Bat 63 and device 30 starting the swing |
| 6 C | Bat 63 and device 30 pre-mid swing and level |
| 6 D | Bat 63 and device 30 at mid swing and level |
| 6 E | Bat 63 and device 30 at mid swing and level—from side view |
| 6 F | Bat 63 and device 30 past mid swing and level |
| 6 G | Bat 63 and device 30 at end of swing |

FIGS. 7 A and 7 B show more components of a batter assist power trainer device 30. FIG. 7 A shows prototype 34 with a bat 63 inserted and removably attached; back panel 48 of device 30; cross strap 49 from end 35 to end 40; removable securement strap 50 such as Velcro®, snaps, zipper or the like; means 51 for adjusting securement strap 50; containment seams 41; and bat 63. FIG. 7 B also provides prototype 34 with a bat 63 inserted and removably attached; back panel 48 of device 30; cross strap 49 from end 35 to end 40; removable securement strap 50 such as Velcro®, snaps, zipper or the like; means 51 for adjusting securement strap 50; containment seams 41; and bat 63.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present inventions are not entitled to antedate such publication by virtue of prior invention. Further, the dates of publication provided may be different from the actual publication dates which may need to be independently confirmed.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b)

or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing FIGS. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques.

With this description it is to be understood that the batter assist power trainer device 30 called a WIND TRAINER is not to be limited to only the disclosed embodiment of product. The features of the a batter assist power trainer device 30 called a WIND TRAINER are intended to cover various modifications and equivalent arrangements included within the spirit and scope of the description.

The present disclosure includes that contained in the appended claims, as well as that of the foregoing description. Although this invention has been described in its preferred form with a certain degrees of particularity, it is understood that the present disclosure of the preferred form has been made only by way of example and that numerous changes in the details of construction and the combination and arrangements of parts may be resorted to without departing from the spirit of the invention.

What is claimed is:

1. A batter assist power trainer device used with a bat with an inner and outer surface comprised of:

(a) an air resistant airfoil structure made of a lightweight, air resistant and flexible material wherein the air resistant airfoil structure is further comprised of a first essentially triangle and a half-moon end section; a second essentially triangle and a half-moon end section with an aperture for the bat; and an essentially rectangular section interposed and securely connected between the two end sections, and wherein the air resistant airfoil structure is further comprised of at least one reinforcing spline/curvable stiffener;

(b) a strap with a mechanical means for connecting the air resistant airfoil structure to the bat; and (c) a removable cross strap connecting the first essentially triangle and the half-moon end section to the second essentially triangle and the half-moon end section wherein the batter assist power trainer device permits a batter to power train and to controllably increase hitting strength which allows the batter to achieve longer hits of a ball for baseball and/or softball.

2. The device in claim 1 wherein the lightweight, air resistant and flexible material of the air resistant airfoil structure is selected from the group consisting of canvas, nylon mesh, and a composite fabric.

3. The device in claim 1 wherein the mechanical means for connecting the air resistant airfoil structure to the bat is selected from the group consisting of hook and loop fasteners, snaps, zippers and mechanical hook and eyes.

4. The device in claim 1 wherein the at least one reinforcing spline/curvable stiffener is selected from the group consisting of tubes, straws, flexible and elongated thin columns of metal, flexible and elongated thin columns of plastic and flexible and elongated thin columns of composite materials.

* * * * *